United States Patent [19]

Bassendale et al.

[11] 4,047,546

[45] Sept. 13, 1977

[54] METHOD AND APPARATUS FOR FILLING CONTAINERS

[75] Inventors: Derrick Arthur Bassendale, Ancaster; Derrick Bartram, Mississauga, both of Canada

[73] Assignee: FMC Corporation, Philadelphia, Pa.

[21] Appl. No.: 549,854

[22] Filed: Feb. 14, 1975

Related U.S. Application Data

[62] Division of Ser. No. 322,523, Jan. 10, 1973, Pat. No. 3,879,917.

[51] Int. Cl.[2] ..... B65B 1/04

[52] U.S. Cl. ..... 141/1 R; 141/67; 141/87

[58] Field of Search ..... 141/67, 68, 87, 11, 141/46, 392, 1, 86, 255, 264; 222/108, 571, 533, 547, 556, 558; 53/28, 37, 180, 182

[56] References Cited

U.S. PATENT DOCUMENTS

| | | | |
|---|---|---|---|
| 1,520,511 | 12/1924 | Reymore | 141/87 |
| 3,285,295 | 11/1966 | Titchenal et al. | 141/68 |
| 3,322,219 | 5/1967 | Van Pernis | 141/68 |
| 3,501,064 | 3/1970 | Gaumer | 222/571 |

*Primary Examiner*—Houston S. Bell, Jr.
*Attorney, Agent, or Firm*—Abner Sheffer; Henry R. Ertelt

[57] ABSTRACT

Packaging of powders in heat-sealed containers.

Each charge of powder is extruded into its container through a powder-filled nozzle having a slot-like outlet, reducing dust formation and deposition on the walls of the container so that good heat seals are formed.

21 Claims, 15 Drawing Figures

FIGS. 1 TO 5 ILLUSTRATE PRIOR ART
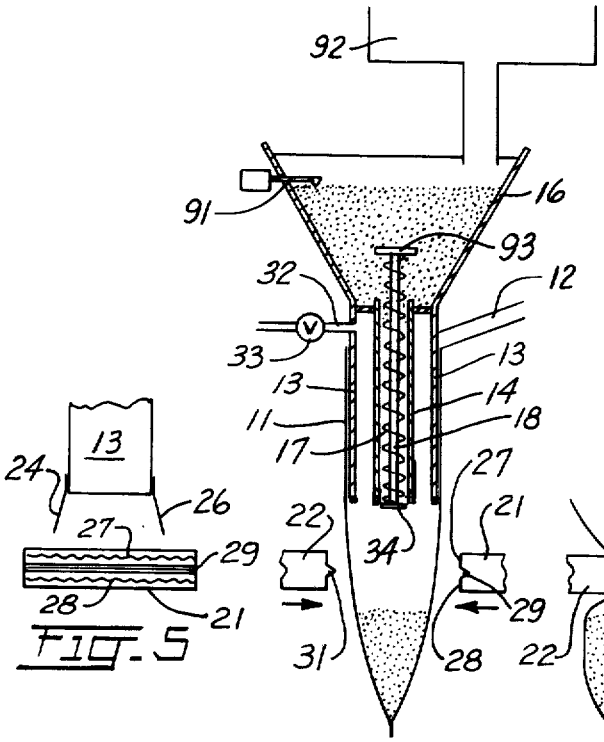
Fig. 5
Fig. 1
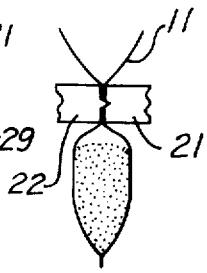
Fig. 2
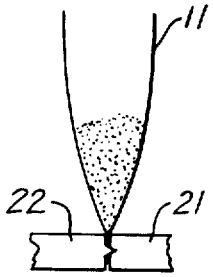
Fig. 3
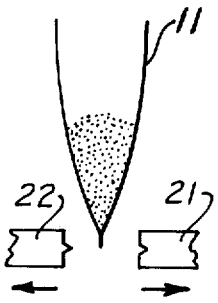
Fig. 4
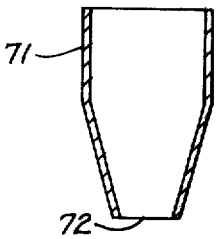
Fig. 11
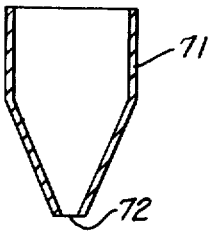
Fig. 12
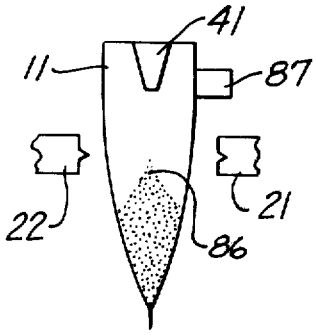
Fig. 15
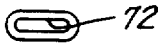
Fig. 13
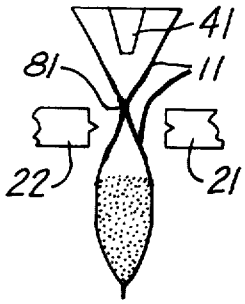
Fig. 14

METHOD AND APPARATUS FOR FILLING CONTAINERS

This is a divisional of application Ser. No. 322,523 filed Jan. 10, 1973, now U.S. Pat. No. 3,879,917 issued Apr. 29, 1975.

This invention relates to the packaging of powders. It enables conventional heat-sealing packaging machinery to be used successfully with dusty powders.

In one aspect of the invention the charge of powder for each container is extruded through a nozzle having a restricted outlet which is sufficiently narrow that the powder becomes packed at the outlet, bridging it and preventing substantial flow therefrom when each extrusion step ends. The extrusion may be effected by conventional means for feeding the charge of powder, such as a metering screw conveyor or auger; other metering devices will readily suggest themselves to those skilled in the art. In one preferred form the cross-sectional area for powder flow at the outlet is appreciably smaller than the corresponding area of the inlet for the nozzle and the nozzle is tapered so that there is a progressive decrease in cross-sectional area as the powder approaches the outlet.

In some cases, there is a slight delayed drip of powder from the nozzle after the conclusion of the extrusion step. This may be due to the formation of an upwardly arched compacted plug of powder at the outlet, while the material just below the arch is less compacted. One embodiment of the invention provides a movable drip catching means to temporarily retain dripped powder and release it during the next filling cycle.

The invention has been found to have its greatest utility for packaging powders in bags which are heat sealed at their ends during the packaging operation, such as bags formed of thermoplastic films; e.g. of polyethylene polypropylene, polyvinyl acetate or cellulose ester or esters; the films may also be water-soluble (e.g. polyvinyl alcohol) particularly for packaging water-dispersible agricultural chemicals so that dispersion of the powder in water may be effected by simply placing the bag in water without first opening it. The packaging material may be a laminate or coated product such as polyethylene-paper laminate, polyethylene-coated paper, heat sealable lacquered paper, aluminum foil laminates, etc. In the broader aspects of the invention the sealing may be effected by techniques other than heat-sealing, and the containers may take other forms; such sealing techniques and other forms of containers are well known in the art.

Certain aspects of the invention are illustrated schematically in the accompanying drawings in which FIG. 1 is a side view, in cross section, of a conventional packaging machine;

FIGS. 2, 3 and 4 are side views illustrating different stages of the bag forming steps during the operation of that machine;

FIG. 5 is a side view at right angles to FIG. 1 of a portion of the machine;

FIGS. 11 and 12 are cross-sectional side views (at right angles to each other) of another form of nozzle;

FIG. 13 is an end view, looking upward at the outlet of the nozzle of FIGS. 11 and 12;

FIG. 14 is a side view illustrating another drip catching technique; and

FIG. 15 is a side view illustrating the use of a vibrator.

Figure 6:
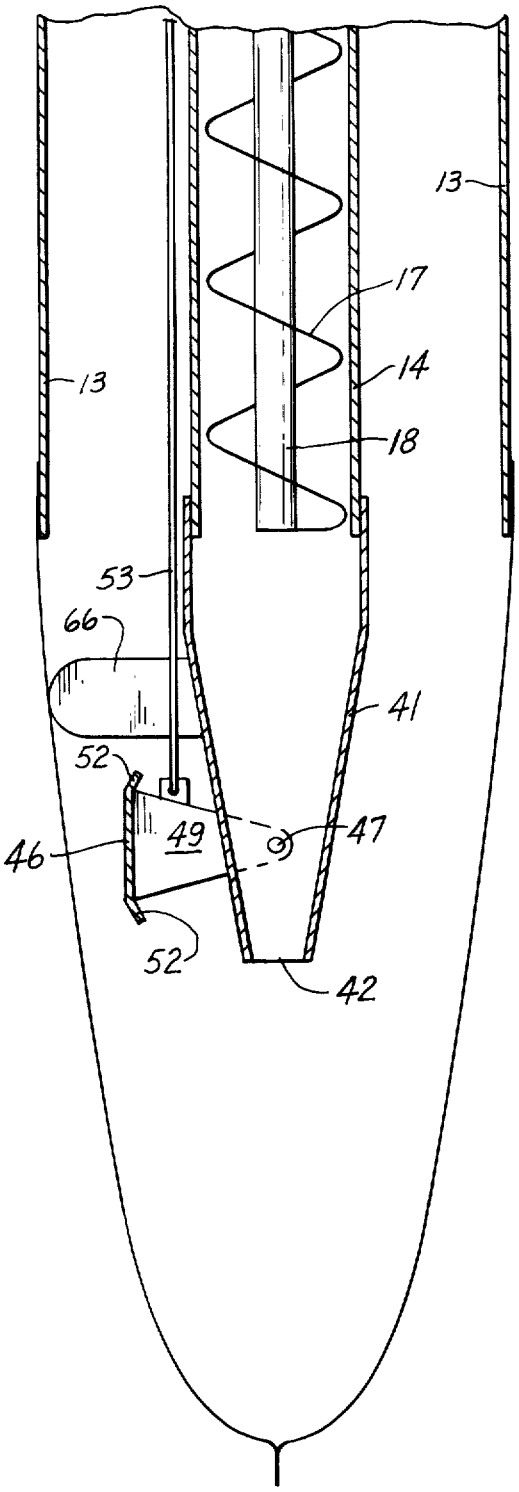
FIG. 6 is a side view showing a nozzle and drip catcher of this invention fitted to that machine.

The device illustrated in the drawings is adapted to be used with a conventional automatic bag forming, filling and closing machine, such as the Hamac-Hansella Transwrap 175H machine. Such machines produce bags automatically. Typically this is done by first forming a tube 11 (FIG. 1) of heat-sealable material (such as polyethylene). Generally the tube is made directly on the machine; the action of the machine draws off a flat heat-sealable film 12 from a roll thereof, bends it into a tubular shape over a cylindrical mandrel 13 and heat-seals the two opposing edges of the film together to form a seam running longitudinally of the tube parallel to its axis.

Located within the mandrel is a supply duct 14 for the material to be bagged. The duct leads downward from a supply hopper 16. Operating within the duct 14 is a metering screw or auger 17 mounted on a driven rotating shaft 18 which is concentric with the axis of the duct.

The heat-sealable film is moved through the machine and formed into bags by the action of a pair of jaws 21, 22 which travel horizontally toward each other to grip the film tube 11 (at a level below the point at which the filling material is supplied) as shown in FIG. 2 and then travel downwardly (while still gripping the tube and thus pulling the tube down along the mandrel) for a distance equal to the height of the bag to be formed to the position shown in FIG. 3. Then the jaws open (FIG. 4) and move upward to their previous upper level, after which they again close onto the tube and repeat the cycle.

Between the mandrel 13 and the jaws 21, 22 the tube 11 slides over a pair of outwardly extended finger guides 24, 26 (FIG. 5) so that the tube becomes somewhat flattened, i.e. wider in its dimension parallel to the lengths of the jaws and narrower in the perpendicular direction.

When the jaws are closed they also act to form two parallel horizontal heat-seals, and to simultaneously cut the bag material between the heat seals. To this end, jaw 21 may have a pair of long spaced horizontal electrically heated wires 27 and 28 between which there is a recess such as a slot or groove 29 which, when the jaws are closed, receives the edge of a knife 31 mounted on the other jaw 22. The lower heat seal serves as the top seal of the filled bag and the upper heat seal serves as the bottom seal of the next bag to be filled while the knife separates the two bags. The machine is conventionally provided with suitable cooling means such as an air blast (not shown) which serves to cool and thereby set the seals.

The operation of the auger is intermittently, being timed in accordance with the cycle of jaw movements. The auger starts to rotate just after the jaws begin their downward movement. The number of rotations of the auger in each cycle is pre-set so as to supply the precise predetermined amount of filling material for each bag and the rate and number of such rotations are pre-set so that the auger concludes its cycle of rotations before the jaws close again at the top of their travel. Suitably the auger stops rotating before the jaws open at the bottom of their travel; at the latest, the auger's rotation ends a sufficient time before the closing of the jaws to ensure that the discharged filling material has by then fallen past the level of the closing jaws. In order that the resulting filled bag not be too bulky owing to the presence of undue amounts of air trapped within the bag, a vacuum line 32 is connected to the interior of the mandrel 13, the vacuum being automatically applied (by the opening of a suitably timed automatically operated valve 33 connected to a vacuum) just before the jaws close to form the heat seals, and the valve 33 being closed just after the jaws have closed. The application of the vacuum gives the film tube a less bulgy, flatter, appearance during operation.

The timing of the operation is regulated and controlled in any suitable manner, which will be apparent to those skilled in the art, as by the use of suitable revolution counters, cams, gears, etc.

The device described above has been used for making filled bags containing granular materials. But when the material to be bagged is a powder, particularly, a powder that dusts easily, the device operates poorly. During filling, the powder deposits on the inner surfaces of the film at the zones where heat-sealing is to take place. The heat seals are poor, e.g. discontinuous, resulting at times in leaky bags. Various devices have been tried, unsuccessfully, in attempt to overcome these defects; these include disks 34 of various shapes (e.g. circles of three-, four- or five-lobed stars) mounted on the lower end of the auger shaft, wires disposed across the discharge opening, intermittently operating closures at the discharge opening, such as conical plugs or clam-shell shutoffs.

According to one embodiment of the present invention the conventional machine just described is made suitable for use with powders by providing it with a nozzle which receives the powder from the auger and which has an outlet sufficiently narrow that the powder bridges the outlet and becomes compacted there, the nozzle becomes filled with powder and remains filled therewith during the operation, and force exerted by the auger is transmitted through the powder in the nozzle to extrude a stream of powder from the outlet when the auger rotates. In one preferred embodiment (FIGS. 6 and 7) the nozzle 41 has a long narrow discharge slot 42 whose long dimension is parallel to the long dimensions of jaws 21, 22 (and also the long dimensions of the flattened film tube). The powder emerges from the nozzle as a relatively flat stream or (as when a highly cohesive powder is highly compacted in the nozzle) as a more or less coherent slab which, however, easily breaks up into the powder during the handling of the bag. In either case the extrusion-compaction by means of the nozzle makes it possible to obtain excellent heat sealing. It has been found that the weight of the material so extruded for each cycle of auger operation is quite constant (except at the very beginning of the run, e.g. for the first few bags being filled). The stream of powder begins to flow from the outlet of the nozzle at substantially full rate practically instantaneously and there is similar practically instantaneous substantially complete cessation of flow from that outlet when the auger stops rotating.

The optimum dimensions of the slot depend in part on the nature of the powder being fed and the rate of feed. Typically, the width of the slot is being 1 inch and above ¼ inch. By simple experimentation, adjusting the width and length of the slot, one can insure that there is formed a compacted plug of such strength at the nozzle outlet that, once the main flow of powder has stopped, there is virtually no delayed slight dripping of powder from that outlet, even though the nozzle is being subjected to the continual vibrations normally generated during the operation of the machine. It has been found, however, that by the use of a drip catcher below the nozzle outlet the same nozzle may serve for a wide variety of powders without such adjustment of its outlet dimensions.

Figure 7:
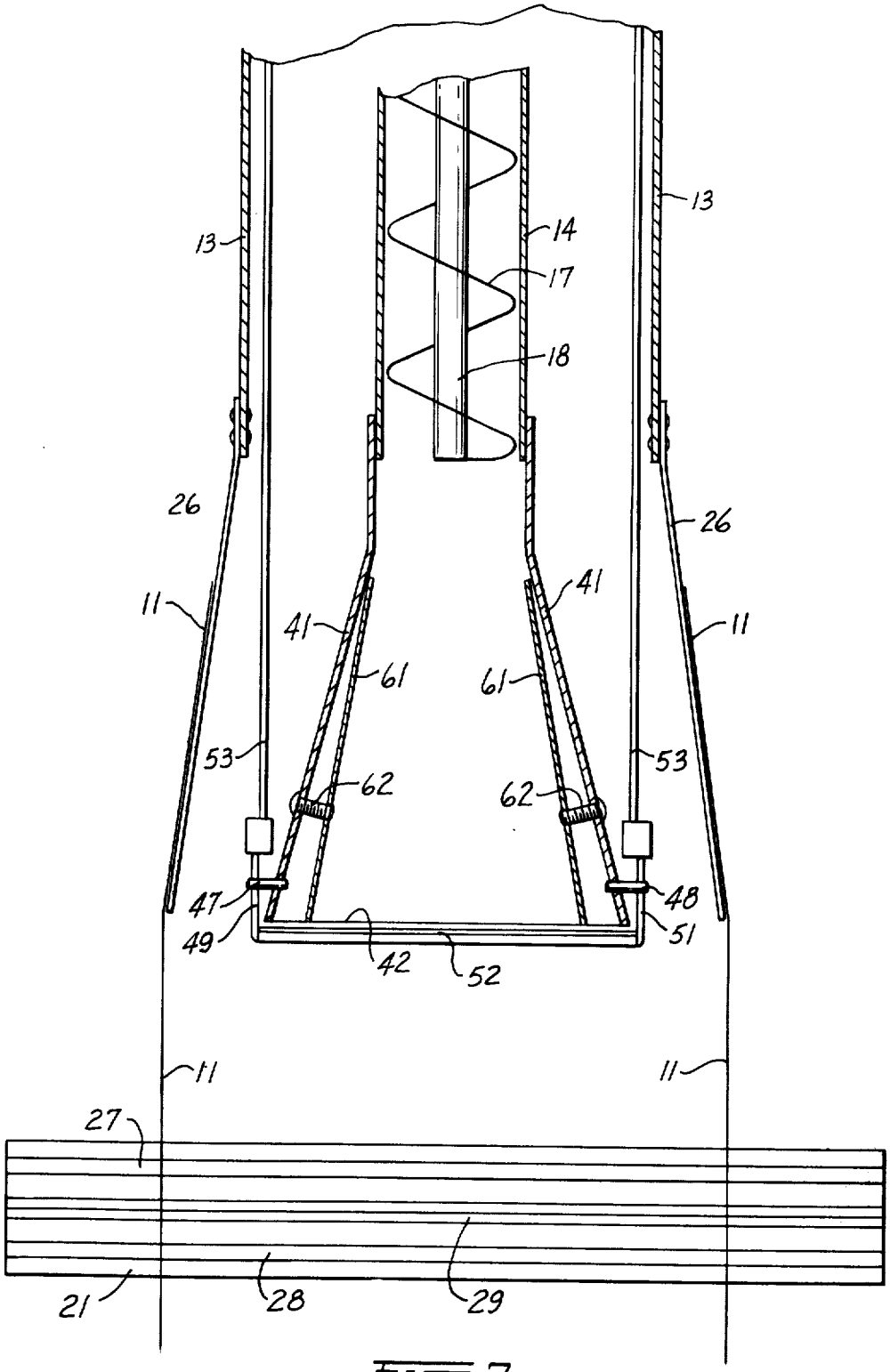
FIG. 7 is a side view at right angles to FIG. 6.

In the embodiment illustrated in the drawing the drip catcher comprises a long tray 46, slightly longer than the slot 42, mounted for swinging movement on horizontal hinge pins 47, 48 which are situated at opposite sides of the nozzle 41 and which pass through upstanding ears 49, 51 formed at the end of the tray 46. When the tray is in its lower, operative, position, it underlies the entire slot 42 (being located, say, about 1/16 inch or more below the slot) so as to receive any loose powder or agglomerate thereof that may drip from the slot. As shown in FIG. 6 it is wider than the slot and has an upwardly sloping edge portion 52 (e.g. making an angle of some 20° with the center portion of the tray) at both its edges to help retain the dripped powder when the tray is in operative position, while allowing that powder to slip off the tray when it is tilted by its movement to inoperative position.

Figure 8:
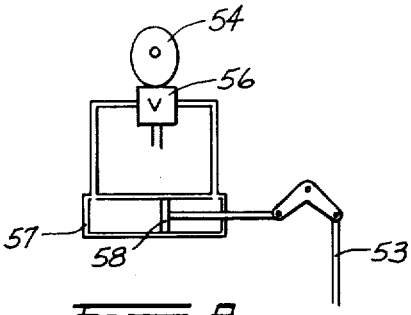
FIG. 8 illustrates a mechanism for operating the drip catcher.

The tray 46 is moved from closed to open position and vice versa by the action of a pair of wires 53 engaging portions of the ears 49, 51. The wires are operated, in any suitable manner, in timed relationship to the rotation of the auger 17, so that just before the auger begins rotating the cut-off is moved to inoperative position and shortly before the jaws reach their lowest level (after the auger stops rotating) the tray is moved to operative position. This operation may be controlled by a cam or cams (FIG. 8) 54 by moving in timed relationship to the auger-controlling cam or cams. The cams 54 may operate an air valve 56 which admits compressed air alternatively to each end of a cylinder 57 having a piston 58 suitably connected to the wires 53.

The nozzle may be formed from an originally circular cylindrical tube by simply flattening it on one end so that it takes a smoothly tapered form, with a smooth transition from the circular inlet end to the long narrow slot at the outlet end. It will be seen that the powder passes from a zone having a relatively large cross sectional area to a slot having a much smaller cross sectional area and that the area is decreased progressively and smoothly. On inspection of a powder-filled nozzle removed from the machine after the machine had been in operation (e.g. by stopping the machine, in the Example given below, just before the jaws close and tearing open the film tube around the nozzle and carefully removing the nozzle including its powder content) it was found that the powder in the lower portion of the nozzle appeared to be more highly compacted than the powder in the upper circular portion thereof; for that particular nozzle the total weight of powder in the nozzle was less than the weight of a single filling of a bag, indicating that the flow, per cycle, through the nozzle was significantly greater than the volume of the nozzle. The nozzle was made of metal of sufficient rigidity to substantially retain its shape during operation and not be visibly deformed under the extrusion pressure.

Figure 9:
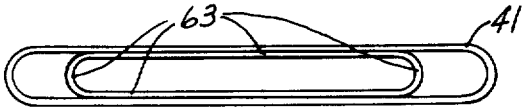
FIG. 9 is an end view, looking upward at the outlet of the nozzle.
Figure 10:
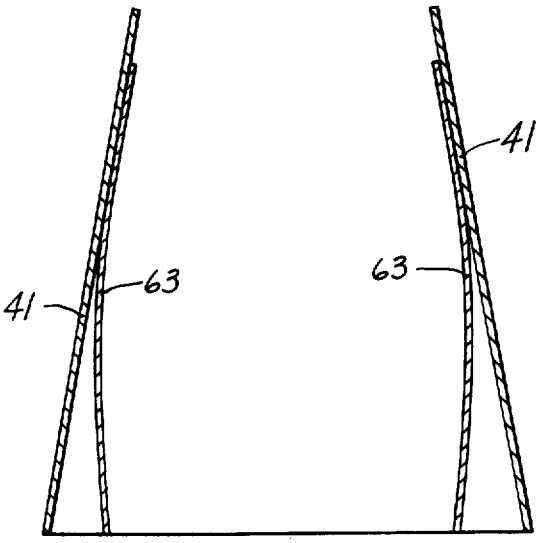
FIG. 10 is a cross sectional side view of the same nozzle.

As previously stated the optimum dimensions of the slot depend on the nature of the powder being fed and the rate of feed. In one embodiment of the invention there is provision for varying the length of the slot by the use of inserts 61 (see FIG. 7). These may be plates of generally triangular shape having suitable means (such as bolts 62) for removably attaching them to opposite narrowing sides of the nozzle at predetermined points. They thus serve to reduce the effective volume of the nozzle and (if the rate of supply by the auger is not changed) to increase the degree of compaction occurring the nozzle. Like the illustrated nozzle itself their construction is such that the powdered material flows over them (from the outlet of the auger) in a smooth substantially unobstructed path. Thus they may be made of smooth stainless steel or aluminum with their upper ends arranged to be substantially flush against the inner wall of the main body of the nozzle. The length of the slot may also be decreased by means of an inner liner 63 (FIGS. 9 and 10), e.g. of heavy polytetrafluorethylene tape, cemented to the inner wall of the main body of the nozzle at its discharge end.

For the filling of bags of relatively small size such that there is danger of contact between the film tube and the nozzle or dip catching mechanism there may be mounted, on one or both of the broad side faces of the nozzle, a wiping pad 66 which may be of resilient material such as foam rubber. This acts to deflect the film so that it does not come so close to the cut-off or the outlet of the nozzle as to pick up some of the powder or become damaged.

Another, less desirable embodiment of the invention is illustrated in FIGS. 11 to 13. Here the nozzle designated as 71, is likewise tapered and it likewise has a long narrow discharge slot 72 at the bottom. But while the nozzle shown in FIGS. 6 and 7 flares outwardly, so that the length of its slot 42 is appreciably greater than the diameter of the auger-containing discharge tube 14 and almost as large as the long dimension of the flattened bag being heat-sealed, the length of the slot 72 of the nozzle 71 shown in FIGS. 11 to 13 is no greater than, and generally less than, the diameter of the discharge tube 14.

In another modification the effect of any dripping may be reduced by the intermittent application of a vacuum sufficiently strong to cause localized substantial collapse of the film tube above the heat-sealing level. As illustrated in FIG. 14 the vacuum may be applied just after the cessation of the main flow of powder from the slot, the reduction in pressure being great enough to form a pinch 81 in the film tube; any drippings then come to rest on the piched area which protects the film below it from contact with dripped powder that could interfere with heat sealing.

In some cases, the compaction of the powder in the nozzle is so great and the powder is so coherent that the top of the powder charge retains a peak 86 (FIG. 15) that extends above the heat-sealing level. This may be prevented by applying vibratory forces to the powder, as by means of a vibrator 87 in contact with the film tube.

To insure that the auger runs full it may be kept totally immersed in the powder supply, e.g. by maintaining the supply hopper 16 substantially full of powder throughout the operation. To this end the supply hopper may be fitted with a pressure-responsive sensor 91 which responds when the level of the powder in the bin falls below a predetermined level and which controls (in well known manner) the supply of material to the hopper, e.g. from an upper storage bin 92. Impeller blades 93 may be mounted on the top of the auger shaft to rotate therewith to mix the powder and move it toward the auger.

EXAMPLE

In one typical operation, used successfully for filling bags with one pound charges of an 80% wettable powder formulation of a fungicide described below, the mandrel 13 is of circular cross section about 3¾ inches in external diameter, the duct 14 is of circular cross section 2 inches in internal diameter, the auger 17 comprises a vertical shaft (18) ½ inch in diameter carrying a helical vane which makes an angle of 25° from the horizontal, the clearance between the outer edge of the auger vane and the inner wall of the duct 14 being about 1/16 inch. The lower end of the auger is about 1¼ inch above the outlet of duct 14. The nozzle 41 is of smooth stainless steel (e.g. type 304 or 316); it has a short cylincrical upper section where it fits over the duct 14 and then, starting a short distance below the bottom of the duct, begins to taper (at an angle of about 7° to the vertical) uniformly towards the outlet slot 42; the tapered section is about 6½ inches high. The slot 42 is ½ inch wide and about 4 inches long but its effective length is reduced by about 1 inch (i.e. to about 3 inches) by the provision of a polytetrafluoroethylene tape liner 63 adhered to its inner walls. Each bag is filled with one pound of the powder; the auger makes 15 revolutions to supply this quantity through the slot 42. The vertical path of travel of the jaws is 11 inches long and begins at a level about 1 inch below the slot 42. The process produces accurated packed bags having excellent heat seals.

The powder used in this Example is a blend of about 80% Polyram (a mixture of 5.2 parts by weight of ammoniates of [ethylenebis (dithiocarbamato)] zinc with one part by weight ethylenebis [dithiocarbamic acid] bimolecular and trimolecular cyclic anhydrosulfides and disulfides), 9.2% sodium lignosulfonate, 1% sodium alkylnaphthalene-sulfonate and 8.2% kaolin clay. The blend is ground in an air-attrition mill to give a product in which at least 80 percent (by weight) of the particles are smaller than 5 microns in diameter. The powder is substantially anhydrous; thus when a weighed sample of the powder is placed in a vacuum oven at 65° C for 24 hours it shows a weight loss (presumably due to evolution of moisture) of 2.7%. In "packed" condition (as defined below) the bulk density of the powder is 54 cubic inches per pound and its "dustiness" level is 4 to 5; in its unpacked condition the corresponding figures are 66 in ³/lb. and 7–8, respectively. To bring the material to packed condition a 25 gram sample of the powder which had been poured into a standard 250 ml beaker (2½ inches in diameter, and 3½ inches high) was gently tapped on a laboratory bench top for 30 seconds. To determine the dustiness level there was employed a standard 2000 ml beaker (5 inches in diameter and 7½ inches high) having equally spaced scale graduations (1 to 10) marked on the side ("10" being 6 inches above the bottom and "0" being at the bottom); a standard 250 ml beaker containing 25 grams of the powder was held within the 2000 ml beaker at a level about 6 inches above its bottom and quickly inverted at that level, so that the powder fell to the bottom of the 2000 ml beaker; the level to which the dust cloud rose therein was observed visually and reported as the dustiness level, "10" representing heavy dusting.

When one removes the powder-filled nozzle from the machine after stopping the machine in the foregoing Example (just before the closing of the jaws), it is found to contain 192.7 grams of powder. When one fills the removed empty nozzle with another sample of the same powder (by simply pouring the powder into the nozzle and leveling off the powder at the top of the nozzle) it is found to hold 165 grams of the powder. Measurements also indicate that the weights of powder delivered to the bags per cycle with and without the nozzle are substantially identical.

Other agricultural chemicals whose formulations, in powder form, have been bagged successfully in accordance with this invention and (in the order given) the "packed" and unpacked bulk densities (in $in^3/lb$), dustiness levels for "packed" and unpacked powders, and moisture contents (in percent) of the powder are as follows: Cyprex 68, 93, 3 to 4, 5 to 6, 0.2%; Linuron 79, 93, 4 to 5, 6 to 7, 0.8%; Patoran 48, 69, 4 to 5, 7 to 8, 1.1%; Thiodan 41, 60, 4 to 5, 10, 1%, Guthion 77, 92, 4 to 5, 7 to 8; Fundal 33, 47, no dust, 2 to 3, 0.2%; Captan 38, 50, 3 to 4, 7 to 8, 0.8%. The invention has also been used successfully for the bagging of a spackling composition containing some 93% of plaster of paris, 1% of water-soluble cellulose ethers, and 5% asbestos "shorts" in which the plaster of paris has the following sieve analysis (in which the sieves are U.S. Standard and the percentages are the proportions remaining on the sieve): 45 mesh, 0%; 70 mesh, trace; 100 mesh, less than 3%; 230 mesh, less than 20%. The invention has been used for filling at high rates, in which each complete cycle of operations takes about two seconds or less, with the powder extrusion portion of the cycle taking less than about a second, e.g. about ½ second. For instance in one typical cycle of operations, the auger starts to rotate about 0.15 second after the closed jaws have begun their downward movement and just after the jaws have passed below the level of the nozzle outlet (during this 0.15 second period the drip catcher moves to inoperative position); the auger continues to rotate for about 0.7 second during which time the downward movement of the jaws continues; about 0.15 second later the jaws open (during this 0.15 second period the drip catcher drops to its operative position); the jaws then travel on their upward stroke for about 0.4 second, the vacuum being applied during this period; the jaws then close in their top position and effect the sealing, an operation which takes about 0.6 second; the total time for the whole cycle is about 2 seconds.

The invention is particularly suitable for use with powders which have a substantial content of fine particles. which particle diameteres are well below 100 microns, e.g. powders which are principally composed of particles below 10 microns in diameter, e.g. 1 to 10 microns, or even less such as ultra fine particles 0.1 to 1 micron diameter. Its principal advantages are found with powders that tend to form dusts, e.g. powders having a dustiness level above 2 or 3. Advantageously the outlet of the nozzle is substantially smooth and substantially free of nicks or burrs of such size as to cause ripples or side sprays in the emerging downwardly directed extruded stream of powder; this helps to minimize deposition of fine powder on the walls of the film at zones where heat sealing is to take place. As illustrated, the outlet may have a surface of very smooth material, such as of low friction organic solid polymer, e.g. a layer of polytetrafluoroethylene or silicone. The nozzle may, if desired, be constructed in whole or in part of polymeric material, such as nylon (e.g. nylon 6,6), oxymethylene polymer (e.g. Delrin or Celcon), or polycarbonate (e.g. Lexan).

In the illustrated embodiments the cylindrical upper section of the nozzle fits tightly over the lower end of duct 14 and is fixed and sealed thereto with suitable tape; other ways of securing and sealing the nozzle will be apparent to those skilled in the art.

It is understood that the foregoing detailed description is given merely by way of illustration and that variations may be made therein without departing from the spirit of the invention. The "Abstract" given above is merely for the convenience of technical searchers and is not to be given weight with respect to the scope of the invention.

We claim:

1. Improved cyclic process for the packaging of dusty powders which comprises intermittently and repeatedly feeding a predetermined quantity of said powder, and discharging said quantity from an outlet into a container for said quantity, each cycle of said process comprising said feeding and discharging steps, wherein the improvement comprises, in each cycle, feeding said predetermined quantity of powder into nozzle means, said nozzle means having an inlet and an outlet and being already filled with powder supplied thereto previous to said cycle and having said powder packed at said nozzle and bridging said outlet, and, by said feeding, forcing a stream of powder from said nozzle outlet into said container, said nozzle outlet being narrower than said nozzle inlet and being sufficiently narrow that the powder becomes packed at said outlet and bridges said outlet preventing substantial further flow therefrom at the conclusion of each of said feeding steps while said nozzle means remains filled with said powder.

2. Process as in claim 1 in which said powder travels downward through said nozzle and into said container, and, when said powder is discharged into said container, said container is positioned vertically with its upper portion around, but spaced from, said nozzle.

3. Process as in claim 1 in which said powder comprises a substantial proportion of particles having a particle diameter below 10 microns.

4. Process as in claim 1 in which said outlet is a slot less than 1 inch wide and said nozzle means provides a smoothly tapered path of decreasing cross section for the flow of powder to said slot.

5. Process as in claim 4 in which said predetermined quantity of powder is fed downward to said nozzle by a rotating screw conveyor having a substantially vertical axis, said powder passing downwardly through said nozzle means.

6. Process as in claim 1 in which said predetermined quantity of powder is fed downwardly to said nozzle by a rotating screw conveyor having a substantially vertical axis, the powder passes downwardly through said nozzle means, said process including the steps of interposing drip catching means intermittently, at the conclusion of each of said feeding steps, in a position between said outlet and the body of powder in said container, and intermittently removing said drip catching means from said position prior to the recommencement of the flow of said powder stream from said outlet, said drip catching means being tilted during said removing step to discharge dripped powder therefrom.

7. Improved apparatus for the packaging of particulate material which comprises means for intermittently and repeatedly feeding a predetermined quantity of said material into a container for said quantity, wherein the improvement comprises means adapting said apparatus for the packaging of dusty powders, said adapting means comprising nozzle means for receiving said powder in said predetermined quantities from said feeding means, said nozzle means having an inlet and an outlet, said outlet being sufficiently narrow that the powder becomes packed at said outlet and bridges said outlet preventing substantial further flow therefrom at the conclusion of each of said feeding steps while said nozzle means remains filled with said powder, whereby during each of said feeding steps said predetermined quantity is forced by said feeding means into said nozzle means and a stream of said powder is forced from said outlet into said container, said inlet being wider than said outlet.

8. Apparatus as in claim 7 in which said outlet is a slot less than 1 inch wide and said nozzle means provides a smoothly tapered path of decreasing cross section for the flow of powder to said slot.

9. Apparatus as in claim 7 in which the powder-holding volume of said nozzle means is less than the volume of powder supplied to said inlet by said feeding means at each feeding step.

10. Apparatus as in claim 9 in which said inlet has a circular cross section which is substantially greater than the cross section of said slot and the length of said slot is greater than the diameter of said inlet.

11. Apparatus as in claim 10 in which said feeding means comprises a rotating screw conveyor having a substantially vertical axis and situated above said nozzle means, the construction and arrangement being such that said powder is fed downwardly by said conveyor and passes downwardly through said nozzle means.

12. Apparatus as in claim 8 in which said feeding means comprises a rotating screw conveyor which has a substantially vertical axis and the powder is fed downwardly thereby and passes downwardly through said nozzle means, said apparatus including means for maintaining said container around, but spaced from, said outlet.

13. Apparatus as in claim 12 and comprising drip catching means and means for interposing said catching means intermittently, at the conclusion of each of said feeding steps, in a position below, and spaced from, said outlet and the body of powder in said container, and for intermittently removing said catching means from said position prior to the recommencement of the flow of said powder stream from said outlet.

14. Apparatus as in claim 13 in which said interposing and removing means intermittently removes said catching means from said position to an inoperative position out of the path of said powder stream prior to said recommencement.

15. Apparatus as in claim 14 in which said maintaining means are situated to provide a space at the side of said nozzle between said nozzle and said container, and said drip catching means are tilted, during said removing step to discharge dripped powder therefrom, to occupy an inoperative position in said space.

16. Process as in claim 5 in which said powder is one which, when in unpacked condition, forms a visible dust cloud when a mass thereof is dropped.

17. Process as in claim 5 in which said powder comprises plaster of paris powder of which less than 3 percent passes through a 100 mesh U.S. Standard sieve.

18. Process as in claim 5 in which said slot has a smooth surface of polytetrafluoroethylene.

19. Process as in claim 5 in which the powder-holding volume of said nozzle means is less than the volume of powder supplied to said inlet by said feeding means at each feeding step.

20. Process as in claim 6 in which said outlet is a slot less than 1 inch wide and said nozzle means provides a smoothly tapered path of decreasing cross section for the flow of powder to said slot.

21. Process as in claim 20 in which said powder comprises a substantial proportion of particles having a particle diameter below 10 microns.

* * * * *